US007158001B2

(12) United States Patent
Matsutani et al.

(10) Patent No.: US 7,158,001 B2
(45) Date of Patent: Jan. 2, 2007

(54) CHOKE COIL AND ELECTRONIC DEVICE USING THE SAME

(75) Inventors: Nobuya Matsutani, Katano (JP); Tsunetsugu Imanishi, Hirakata (JP); Hidenori Uematsu, Kadoma (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 13 days.

(21) Appl. No.: 10/806,385

(22) Filed: Mar. 23, 2004

(65) Prior Publication Data

US 2004/0189430 A1 Sep. 30, 2004

(30) Foreign Application Priority Data

Mar. 26, 2003 (JP) ..... 2003-085049

(51) Int. Cl.
*H01F 27/08* (2006.01)

(52) U.S. Cl. ..... 336/55; 336/61; 336/83; 336/200

(58) Field of Classification Search ..... 336/55–62, 336/83, 200, 220–223, 232
See application file for complete search history.

(56) References Cited

U.S. PATENT DOCUMENTS

| | | | | |
|---|---|---|---|---|
| 5,210,513 | A * | 5/1993 | Khan et al. | 336/61 |
| 6,198,375 | B1 * | 3/2001 | Shafer | 336/225 |
| 6,392,519 | B1 * | 5/2002 | Ronning | 336/90 |
| 6,710,691 | B1 * | 3/2004 | Yu et al. | 336/55 |

FOREIGN PATENT DOCUMENTS

| | | | |
|---|---|---|---|
| JP | 4-267313 | | 9/1992 |
| WO | WO 98/06113 | * | 2/1998 |

* cited by examiner

*Primary Examiner*—Tuyen T Nguyen
(74) *Attorney, Agent, or Firm*—Steptoe & Johnson LLP

(57) ABSTRACT

A choke coil according to the invention is configured to include: a coil incorporated with terminals and/or intermediate tap, the coil configured of a metal plate being punched and folded; a magnetic material buried with the coil therein; and a radiator of a material with excellent thermal conductivity disposed on a surface of the magnetic material. A small-sized, low-profile choke coil structurally stable with excellent heat dissipation is to be provided.

8 Claims, 7 Drawing Sheets

CHOKE COIL AND ELECTRONIC DEVICE USING THE SAME

FIELD OF THE INVENTION

The present invention relates to a choke coil usable for a DC/DC converter mounted on various electronic devices, and an electronic device using the same.

BACKGROUND OF THE INVENTION

In recent years, the realization of reduction in the size and thickness of choke coils themselves is demanded with the further progress of the realization of reduction in the size and thickness of electronic devices. Furthermore, a supply capacity of a few to a few tens amperes of high current is desired in a high frequency band responding to the realization of high speed and high integration of LSIs such as a CPU, which causes a problem of heat generation from the CPU and the choke coil.

In traditional winding inductance components, the heat problem like this is tried to be solved by tightly forming a resin material with high heat dissipation around a core and a winding to cover them with a case of a material with high thermal conductivity (see JPH4-267313, page 73, FIG. 1, for example).

However, in the traditional winding inductance components covered with the case cannot sufficiently respond to the realization of reduction in size and thickness and the realization of high frequency and high current, and they cannot sufficiently meet the problem of heat generation as well.

SUMMARY OF THE INVENTION

An object is to provide a choke coil including:

a coil incorporated with terminals and/or intermediate tap, the coil configured of a metal plate being punched and folded;

a magnetic material buried with the coil therein; and a radiator of a material with excellent thermal conductivity disposed on a surface of the magnetic material.

DESCRIPTION OF THE PREFERRED EMBODIMENT

Hereinafter, embodiments according to the invention will be described with reference to the drawings.

(Embodiment 1)

Figure 1A:
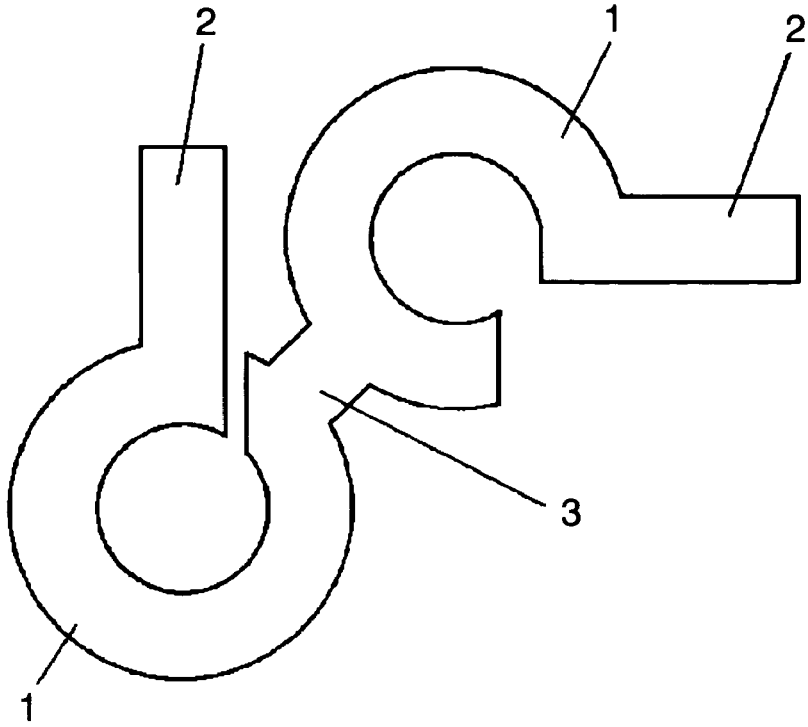
FIG. 1A is a top view illustrating a coil incorporated with terminals before folded.

First, as shown in FIG. 1A, a coil incorporated with terminals is formed by etching or punching a metal plate such as copper and silver, which is formed of two circular disks 1 cut into a ring shape and two terminals 2 extended therefrom.

Figure 1B:
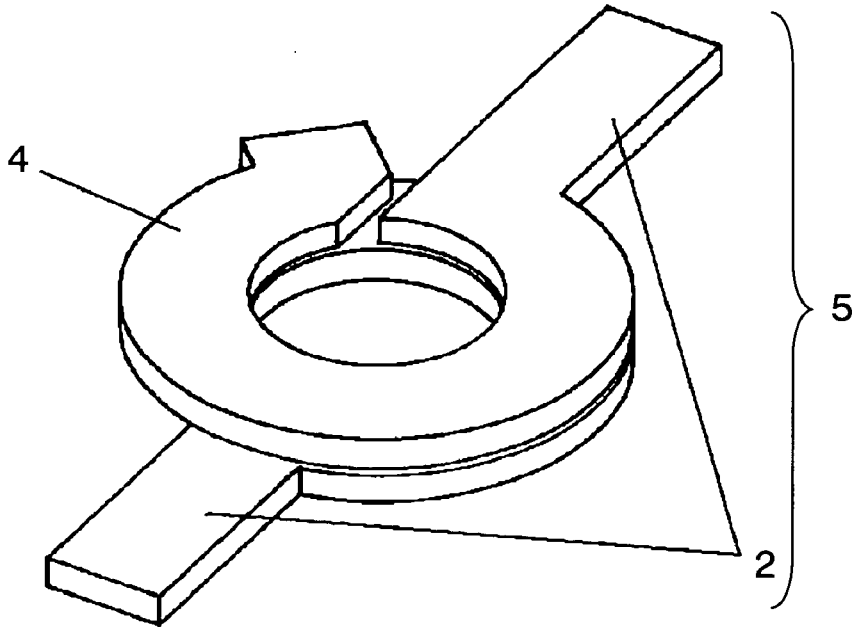
FIG. 1B is a perspective view illustrating the same.

This punched plate is folded at a fold 3 where the circular disks 1 are connected so as to overlay the center points each other. Thus, as shown in FIG. 1B, a plurality of the circular disks 1 becomes a coil portion 4, and the two terminals 2 are disposed radially to the center of the coil portion 4 for forming a coil incorporated with terminals 5.

In addition, the number of turns of the coil 5 incorporated with terminals is not integers in particular, it is freely set to 1.5 turn and 1.75 turn as similar to the traditional coil; the size and the inductance value are the same.

An insulation layer 6 is provided on the circular disks 1 forming the coil portion 4 for avoiding short circuits. On this account, the circular disks can be laminated with no space in folding to allow implementing a small-sized, low-profile coil with an excellent space factor.

Correspondingly, the insulation layer 6 is not provided on the fold 3. This is because it is likely to cause breakage in the insulation layer 6 due to the difference in manners of expansion and contraction between the outer side and the inner side of the bent fold 3 when the circular disks 1 are laminated.

Subsequently, for a magnetic material 7, a composite magnetic material is used in which 3.3 pts. wt. of a silicon resin is added and mixed with soft magnetic material alloy powder to form size-selected powder through a mesh. The soft magnetic material alloy powder is soft magnetic material alloy powder of Fe (50) Ni (50) in an average grain size of 13 μm fabricated by water atomization process.

In addition, in the magnetic material 7 of Embodiment 1, each grain of the soft magnetic material alloy powder is coated with an insulation resin. The soft magnetic material alloy powder has excellent saturation magnetic flux density, but it has low resistance and great eddy current loss. Therefore, the powder grains of the soft magnetic material alloy powder are formed into composites coated with the insulation resin to solve the problem for meeting high frequencies.

Furthermore, the magnetic material 7 secures insulation in itself even though it is interposed between the plurality of the circular disks 1 to be the coil portion 4. Thus, it is unlikely to have a short circuit, and it can be the coil portion 4 in low profile with a high space factor. Moreover, when a plurality of the coils 5 incorporated with terminals is buried in the magnetic material 7, short circuits between the coils 5 incorporated with terminals and short circuits with other components after mounted can be reduced.

Besides, the composition of the soft magnetic material alloy powder contains 90 wt % or more of Fe, Ni and Co in the total amount and the filling factor of the soft magnetic material alloy powder is set to 65 to 90 volume percentage, which allows obtaining the magnetic material 7 of a composite magnetic material with high saturation magnetic flux density and high magnetic permeability.

In addition, when the average grain size of the soft magnetic material alloy powder is set to 1 to 100 μm, it is effective to reduce eddy current.

For the magnetic material 7, a ferrite magnetic material or a composite of ferrite magnetic powder and an insulation resin can provide the same advantages as well. Its resistance becomes higher than that of the soft magnetic material alloy powder, but the resistance prevents eddy current from being generated. Therefore, it can meet high frequencies.

The choke coil is configured by disposing the coil 5 incorporated with terminals inside the magnetic material 7. First, the magnetic material 7 to cover the air core part and the coil portion 4 of the coil 5 incorporated with terminals is formed so as to follow the shape of the coil portion 4 above and below. The coil portion 4 is sandwiched by the magnetic material 7 partially cured, and a pressure of 3 ton/cm$^2$ is applied. It is heat treated at a temperature of 150° C. for about one hour to further cure the magnetic material 7.

Subsequently, plate-shaped radiators 8 are provided on the top and under surfaces of the cured magnetic material 7. The radiator 8 is formed of a copper plate, and a nickel layer for preventing oxidation is formed on the surface by sputtering, plating, and vapor deposition. Furthermore, recesses 8*a* where the terminals 2 extended from the side surfaces of the magnetic material 7 are folded in are provided on the end part of the radiator 8 provided on the under surface of the magnetic material 7.

Moreover, a foundation layer 9 made of Ni is formed over the exposed part of the terminal 2 as an antioxidant for the metal plate such as copper and silver. Besides, a surface layer 10 made of solder or Sn is formed for preventing oxidation and increasing solder wettability of the foundation layer 9 of Ni. Since all the terminals 2 thus exposed outside are folded along the bottom of the choke coil and the surfaces adjacent to the bottom, high density mounting is possible as compared with coils having terminals 2 drawn outside.

Figure 2A:
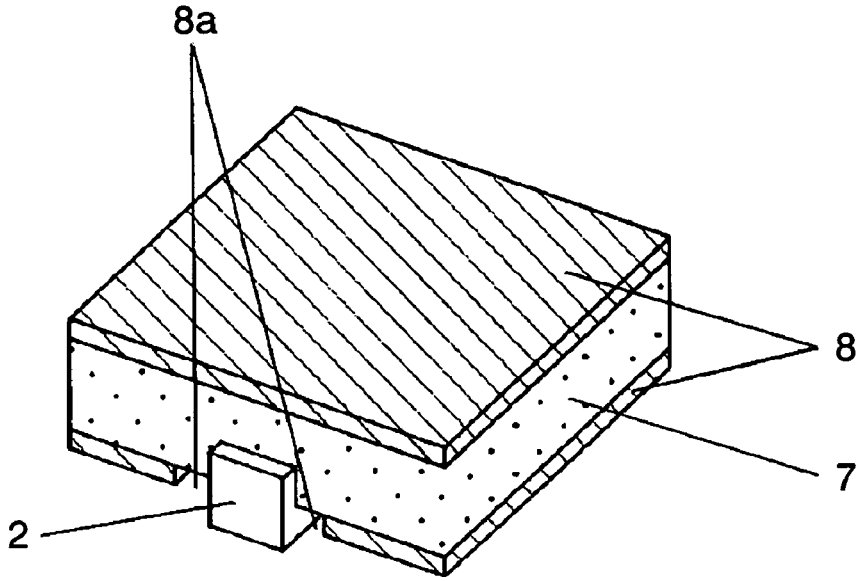
FIG. 2A is a perspective view illustrating a choke coil according to the invention.
Figure 2B:
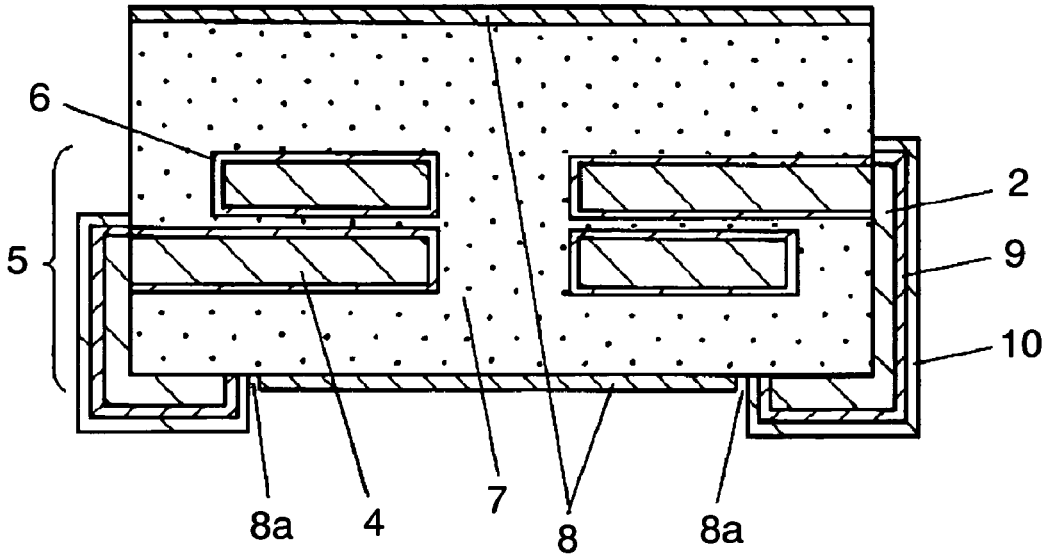
FIG. 2B is a cross-sectional view illustrating the same.
Figure 3:
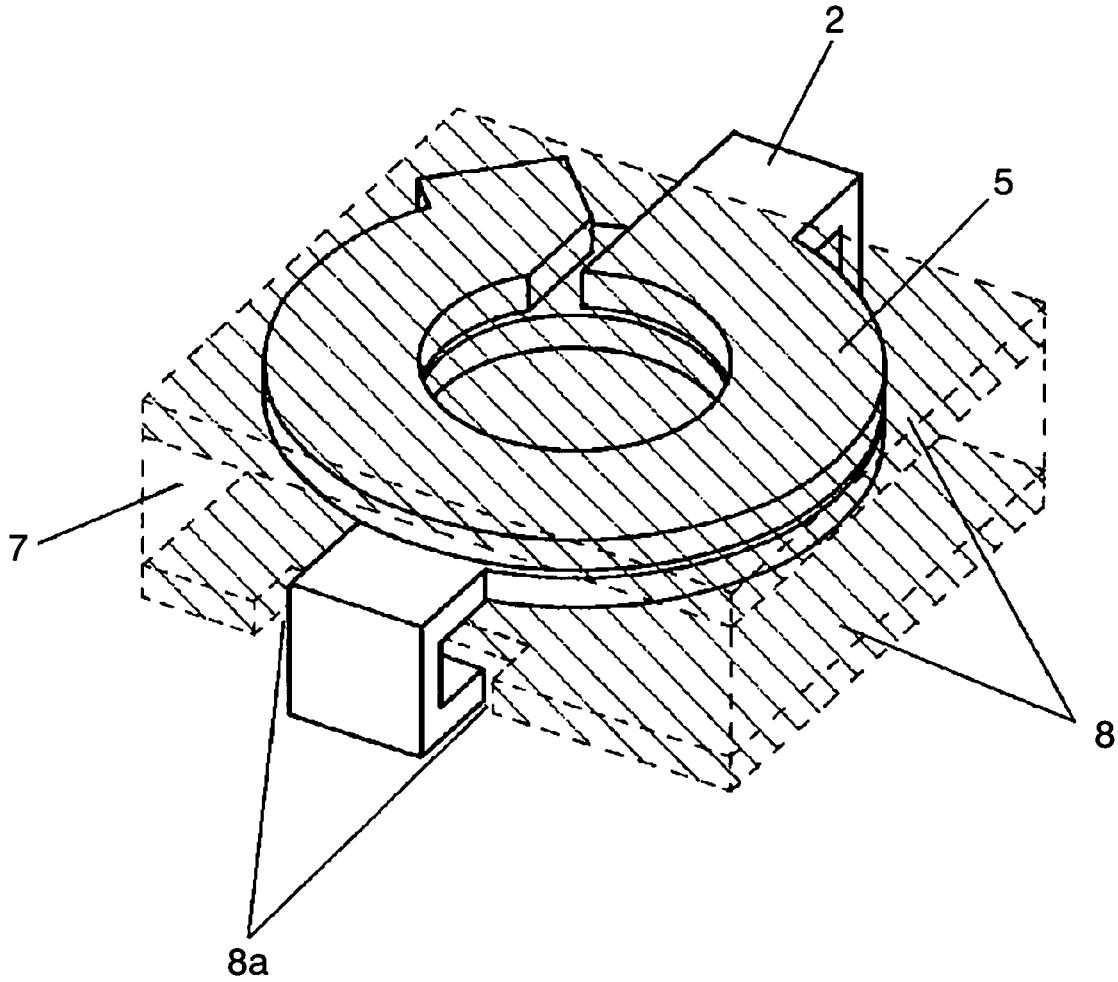
FIG. 3 is a perspective view illustrating the choke coil according to the invention when seen from above obliquely.

FIG. 2A is a perspective view illustrating the choke coil thus completed, and FIG. 2B is a cross-sectional view illustrating the same. FIG. 3 is a perspective view illustrating the choke coil when seen obliquely.

Furthermore, the magnetic material 7 is preferably formed in a square pole. This is because vacuuming for automatic mounting is reliable. Furthermore, it is acceptable that the magnetic material 7 is cut out its corners and is formed into a polygon and a cylinder because of the orientation of mounting and showing the polarity of the terminals. Besides, vacuuming is facilitated when at least the top surface is flat.

The choke coil of Embodiment 1 is disposed with the radiators 8 on the top and under surfaces thereof. The radiator 8 on the top surface of the choke coil has advantages of dissipating heat generated from the choke coil itself upward and receiving and releasing heat from a CPU to surroundings. At this time, heat can be released more easily when the choke coil is disposed in close contact with a heatsink.

In addition, the radiator 8 on the under surface has advantages of releasing heat generated from the choke coil and also releasing heat from the adjacent CPU to a circuit board to allow the operability of an electronic device not to be impaired. Furthermore, the radiator 8 can be formed at desired places in accordance with the structure of circuit boards, and can meet different heat dissipation paths as well.

Moreover, the radiator 8 is formed of the copper plate in Embodiment 1, but materials with excellent thermal conductivity such as aluminum are used other than copper to expect further advantages.

Besides, the materials with excellent thermal conductivity in the invention are materials having thermal conductivity higher than that of air.

As for a method for fabricating the same, products structurally stable and resistible against external force can be fabricated by pasting, burying, sputtering, vapor deposition, and plating.

In addition, as for the shape, a single surface of the magnetic material 7 is unnecessarily coated entirely, it can be shaped into any desirable shapes such as a rectangular shape smaller than a circular shape or the surface area of the magnetic material 7.

(Embodiment 2)

Figure 4A:
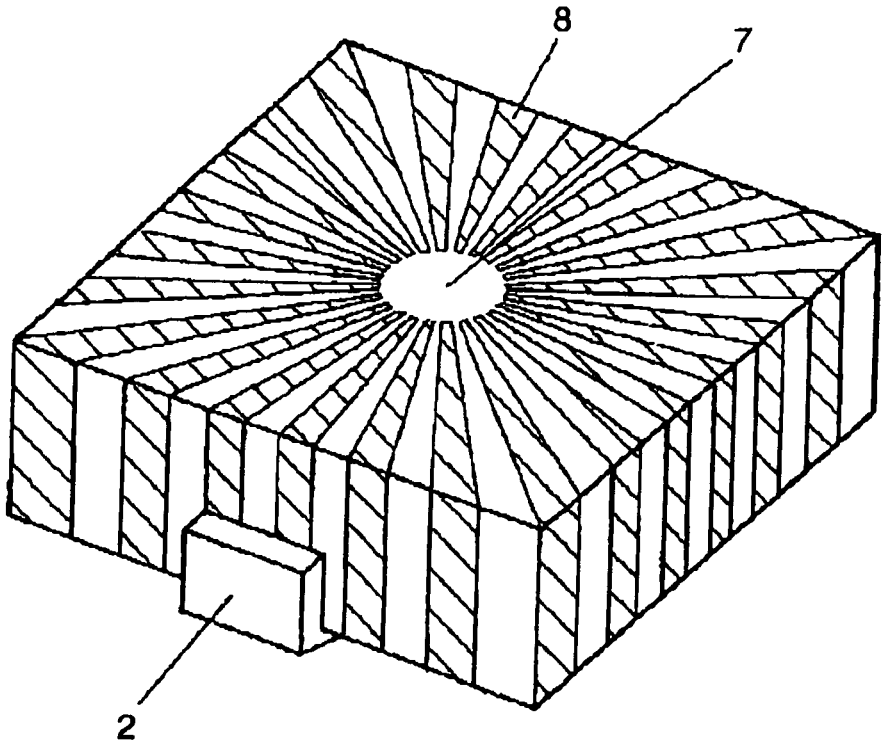
FIG. 4A is a perspective view illustrating another choke coil according to the invention.
Figure 4B:
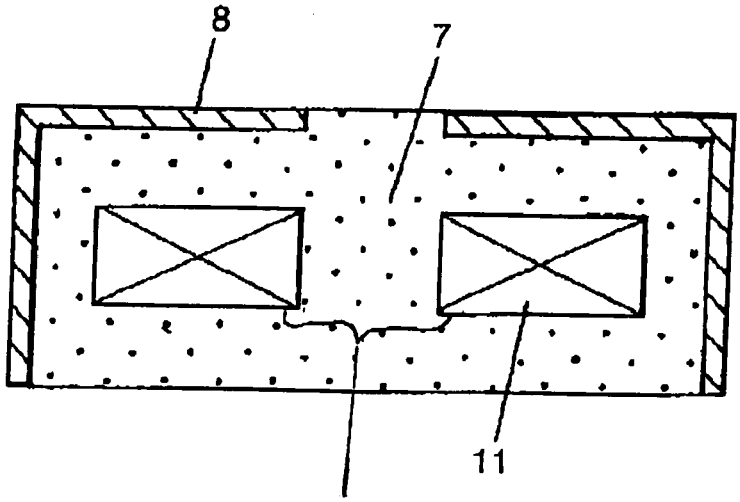
FIG. 4B is a cross-sectional view illustrating the same.

FIG. 4A is a perspective view illustrating a choke coil of Embodiment 2, and FIG. 4B is a cross-sectional view illustrating the same. A coil 11 incorporated with intermediate tap and terminals is formed in which a radiator 8 is buried in the surface of a magnetic material 7 having the coil 11 therein so that the radiator 8 is spread radially from the position corresponding to the air core part of the coil 11 and is extended to the side surface of the magnetic material 7.

Figure 5:
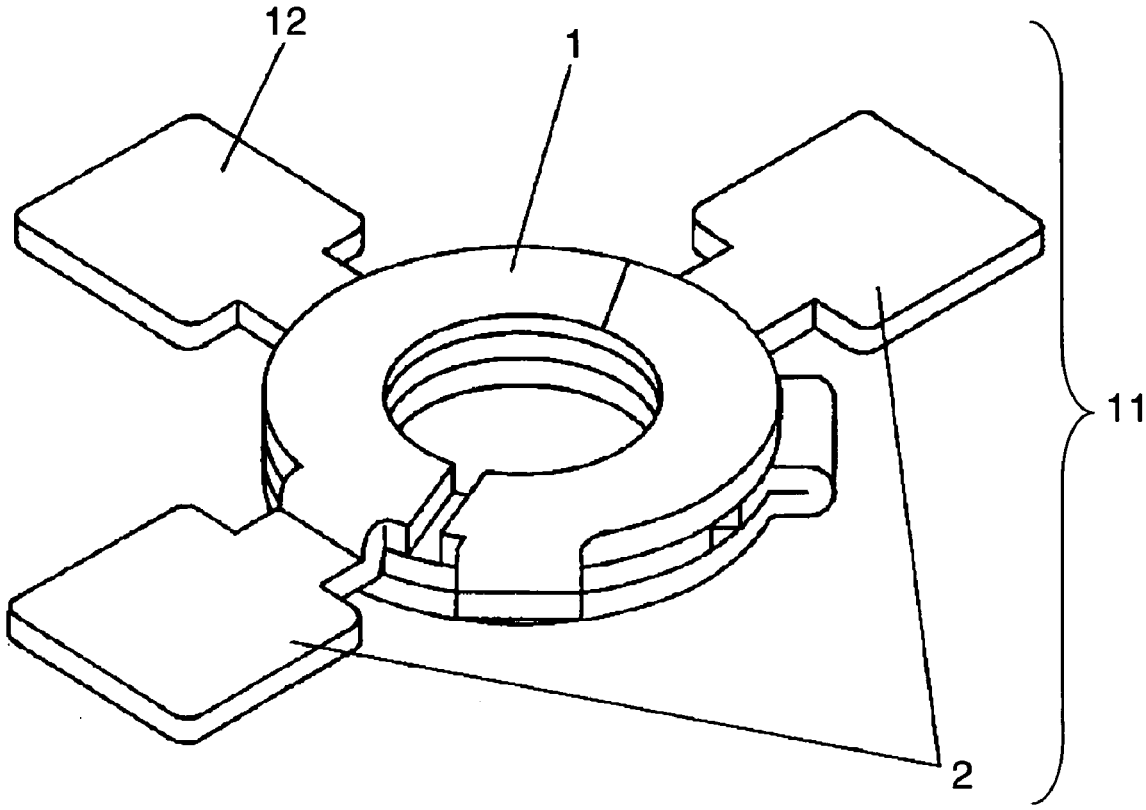
FIG. 5 is a perspective view illustrating a coil incorporated with intermediate tap and terminals according to the invention.

As shown in FIG. 5, the coil 11 incorporated with intermediate tap and terminals is formed in which an intermediate tap 12 is projected from one of the plurality of the circular disks 1 of the coil 5 incorporated with terminals according to Embodiment 1.

The other configurations are the same as those of Embodiment 1.

Hereinafter, advantages of the configuration will be described.

In the choke coil of Embodiment 2, the radiator 8 is formed radially so that it is extended from the part corresponding to the air core part of the coil 11 on the top surface of the magnetic material 7 through the side surface to the lower surface, which provides the structure easily dissipating heat to the surroundings by natural convection. Furthermore, it is possible that heat from a CPU disposed near the choke coil is also absorbed and released to a circuit board.

Moreover, the radiator 8 spread radially is formed to provide an advantage of preventing heat generation as well. When current is carried through the coil 11 in general, there is magnetic flux penetrating through the center of the coil 11. The magnetic flux forms a magnetic circuit that spreads radially from the center, passes the side surface of the coil 11 and returns the center of the coil 11, but eddy current tends to be generated when a metal material is used for the radiator 8 and it is difficult to suppress heat generation. However, when the radiator 8 spread radially is formed so as to block eddy current causing a temperature rise as described above, a choke coil with less heat generation can be formed. In addition, it is acceptable that the length of the radiator 8 formed radially is shortened and is formed only on the top surface or the under surface.

(Embodiment 3)

Figure 6A:
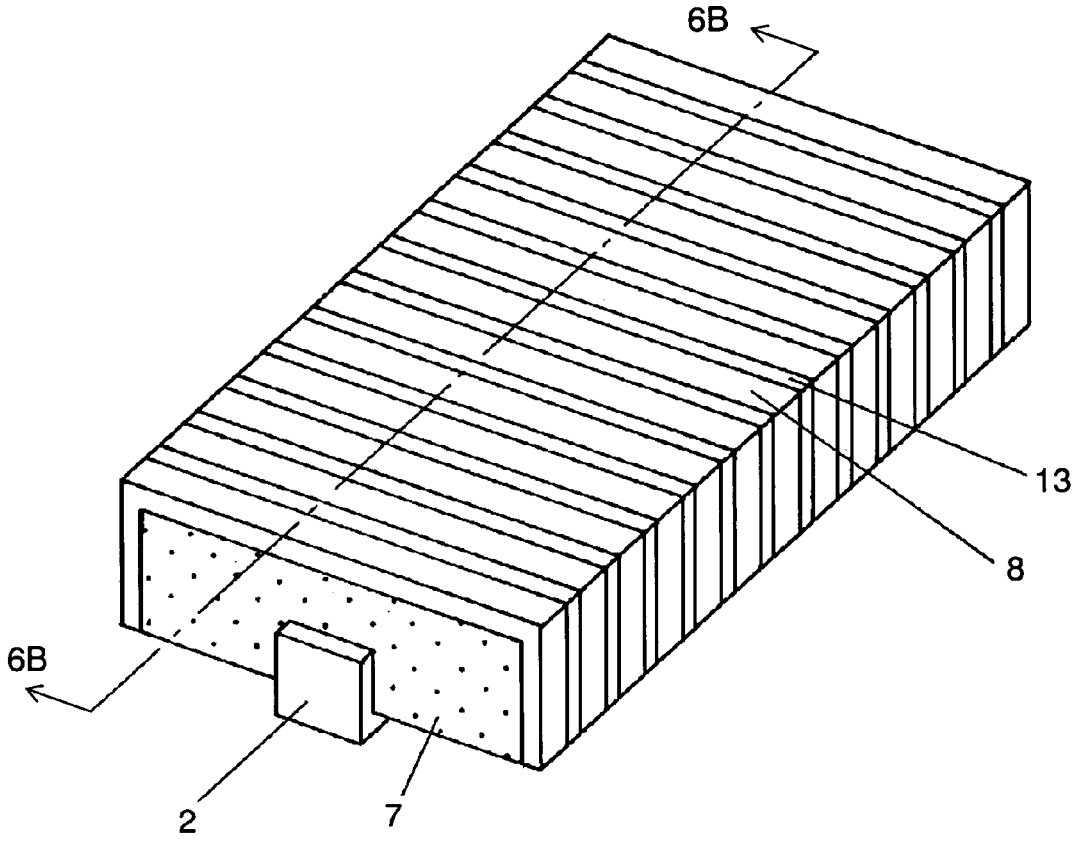
FIG. 6A is a perspective view illustrating still another choke coil according to the invention.
Figure 6B:
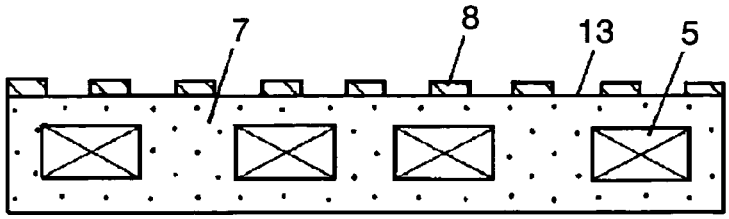
FIG. 6B is a cross-sectional view illustrating the same.

FIG. 6A is a perspective view illustrating a choke coil of Embodiment 3, and FIG. 6B is a cross-sectional view illustrating line 6B—6B shown in FIG. 6A. A radiator 8 is formed on the top surface and two adjacent side surfaces of a magnetic material 7 having two coils 5 incorporated with terminals buried therein side by side, and a plurality of slits 13 is disposed in the radiator 8 at fixed intervals. The other configurations are the same as those of Embodiment 1.

According to this configuration, air flows along the slits 13 to allow quickly lowering heat by air cooling.

Furthermore, the slits 13 are disposed in the radiator 8 only on the top surface and the two adjacent side surfaces at fixed intervals in Embodiment 3, but hey can be formed any surfaces of the magnetic material 7 in accordance with the arrangement of a circuit board and devices to be mounted.

Moreover, any orientations and intervals are fine in the slits 13, they can be determined in accordance with the direction of heat dissipation and the relationship of other electronic components.

(Embodiment 4)

Figure 7:
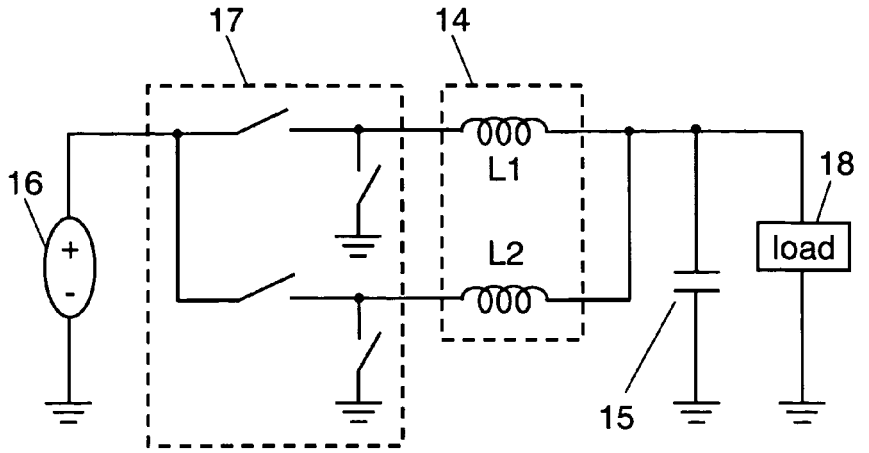
FIG. 7 is a power source circuit diagram of an electronic device using the choke coil according to the invention.

FIG. 7 depicts a power supply circuit of an electronic device with a multi-phase system in which an integration circuit is formed by a choke coil 14 and a capacitor 15. An input terminal 16, and a switching element 17 are connected thereto, and a load 18 such as a CPU is connected to the output of the power supply circuit.

Two coils 5 incorporated with terminals are buried in the choke coil 14 of Embodiment 4 according to the invention, and the two coils 5 phase-control and drive a plurality of DC/DC converters in parallel. According to this circuit configuration, the realization of high frequency and high current is feasible, and the heat problem is reduced by mounting the choke coil 14 according to the invention.

Figure 8:
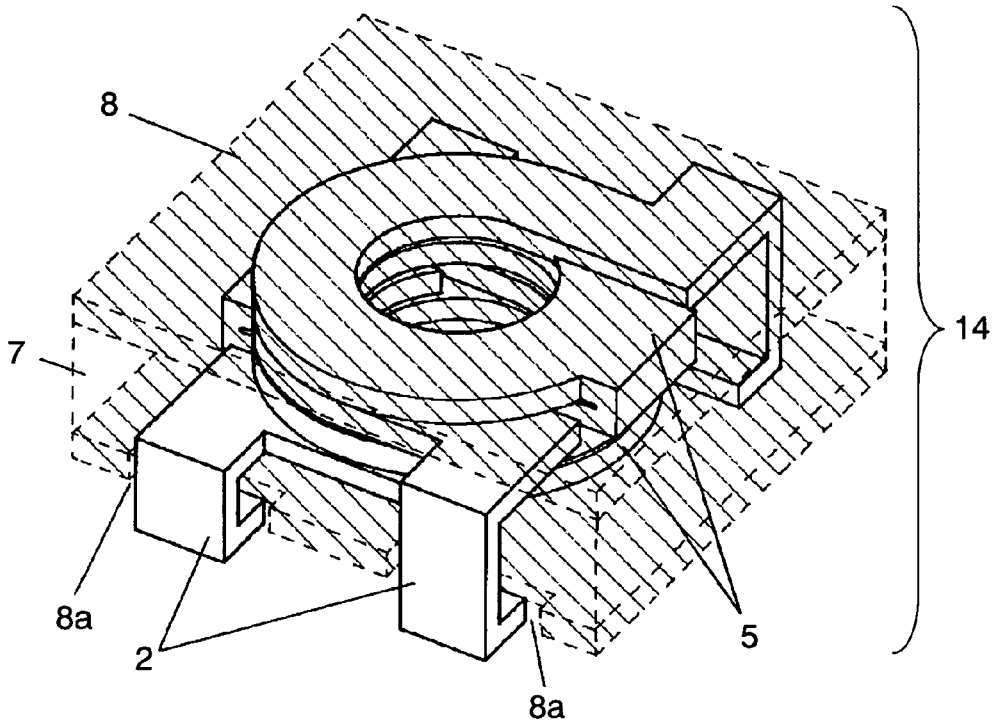
FIG. 8 is a perspective view illustrating yet another choke coil according to the invention when seen from above obliquely.

FIG. 8 is a perspective view illustrating the choke coil 14 of Embodiment 4 when seen from above obliquely. The choke coil 14 is formed of two coils 5 incorporated with terminals vertically laminated and a magnetic material 7, in which a radiator 8 is disposed on the top and under surfaces. Since the radiator 8 is formed of an elastic body mixed with metal powder and fibers, it has excellent thermal conductivity and flexibility. In addition, recesses 8*a* are provided on the radiator 8 on the under surface for preventing short circuits with terminals 2. The other configurations are the same as Embodiment 1.

The choke coil 14 is disposed so that the radiator 8 formed on the top surface is contacted with the lower part of a heatsink of the CPU. On this account, the radiator 8 with flexibility follows the shape of the heatsink, and the contacted surface area is always the maximum. When it is disposed in close contact with the heatsink such as the CPU, it can be deformed in accordance with the shape of a product in close contact, and the heat of the heatsink can be absorbed reliably to dissipate heat effectively.

In other words, the configuration can provide the choke coil 14 with highly effective heat dissipation.

Furthermore, not limited to Embodiments 1 to 4, the radiator 8 can provide the same advantages even though it is disposed on any surfaces of the magnetic material 7 in accordance with the arrangement of other electronic components.

Moreover, as for the shape, any combinations are possible in accordance with various purposes including a plate shape, a radial shape, a shape with flexibility, and a shape with slits at fixed intervals.

Besides, as for the types of coils buried in the magnetic material 7, any combinations can be used such as combinations of a plurality of the coils 5 incorporated with terminals and a plurality of the coils 11 incorporated with intermediate tap and terminals. And, any arrangements are possible such as lateral, vertical, V-shaped arrangements and an interlock between the coil portions.

In addition, not limited to the power supply circuit with the multi-phase system, the choke coil according to the invention can be used for power supply circuits that can be ready for the realization of high frequency and high current, and can exert the same advantages.

Furthermore, the choke coil according to the invention is preferably used for electronic devices such as personal computers and cellular phones.

As described above, according to the invention, the choke coil includes: a coil incorporated with terminals and/or intermediate tap, the coil configured of a metal plate being punched and folded; a magnetic material buried with the coil therein; and a radiator of a material with excellent thermal conductivity disposed on a surface of the magnetic material. Therefore, a small-sized, low-profile choke coil structurally stable with excellent heat dissipation can be provided.

What is claimed is:

1. A choke coil comprising:

a coil with at least one of terminals and an intermediate tap, the coil comprising punched and folded metal plate having at least two semi-circular disks folded over each other;

said coil embedded in a curable magnetic material which is molded together with said coil; and a radiator comprising a material having thermal conductivity higher than that of air located on a surface of the fully cured magnetic material.

2. The choke coil according to claim 1, wherein the radiator is located on at least one of a top surface and an under surface of the magnetic material.

3. The choke coil according to claim 2, wherein the radiator extends outwardly from the top surface of the magnetic material or re-enters said magnetic material through a side surface, and extends to the under surface of said magnetic material.

4. The choke coil according to claim 1, wherein the radiator extends radially just above the location of an air core of the coil.

5. The choke coil according to claim 1, wherein the radiator includes a plurality of parallel slits.

6. The choke coil according to claim 1, wherein the radiator comprises a flexible material.

7. The choke coil according to claim 1, wherein the magnetic material comprises material selected from the group consisting of at least one ferrite magnetic material, a composite of ferrite magnetic powder, an insulation resin, and a composite of soft magnetic material alloy powder, and an insulation resin.

8. An electronic device mounted with a DC/DC converter thereon, wherein the DC/DC converter uses a choke coil including:

a coil with at least one of terminals and an intermediate tap, the coil comprising a punched and folded metal plate having at least two semi-circular disks folded over each other;

said coil embedded in a curable magnetic material which is molded together with said coil; and a radiator comprising a material having thermal conductivity higher than that of air located on a surface of the fully cured magnetic material.

* * * * *